US010467945B2

(12) United States Patent
Matsumoto et al.

(10) Patent No.: US 10,467,945 B2
(45) Date of Patent: Nov. 5, 2019

(54) DISPLAY DEVICE

(71) Applicant: NICHIA CORPORATION, Anan-shi (JP)

(72) Inventors: Makoto Matsumoto, Tokushima (JP); Haruhisa Taguchi, Yokohama (JP)

(73) Assignee: NICHIA CORPORATION, Anan-shi (JP)

( * ) Notice: Subject to any disclaimer, the term of this patent is extended or adjusted under 35 U.S.C. 154(b) by 0 days.

(21) Appl. No.: 16/019,544

(22) Filed: Jun. 27, 2018

(65) Prior Publication Data

US 2019/0005865 A1 Jan. 3, 2019

(30) Foreign Application Priority Data

Jun. 28, 2017 (JP) ..... 2017-126797

(51) Int. Cl.
*G09G 3/32* (2016.01)
*G09G 3/20* (2006.01)

(52) U.S. Cl.
CPC ..... *G09G 3/2077* (2013.01); *G09G 3/2022* (2013.01); *G09G 3/2074* (2013.01); *G09G 3/32* (2013.01); *G09G 2320/0295* (2013.01)

(58) Field of Classification Search
None
See application file for complete search history.

(56) References Cited

U.S. PATENT DOCUMENTS

2010/0053223 A1 3/2010 Otsuka et al.
2010/0237801 A1* 9/2010 Hamada ..... G02B 6/0068 315/294
2013/0057599 A1* 3/2013 Teranuma ..... G02B 27/2264 345/690
2018/0151110 A1* 5/2018 Matsumoto ..... G09G 3/2014

FOREIGN PATENT DOCUMENTS

JP 2010-054989 3/2010

* cited by examiner

*Primary Examiner* — Joseph R Haley
(74) *Attorney, Agent, or Firm* — Mori & Ward, LLP

(57) ABSTRACT

In a predetermined main frame, a display device exerts lighting control on a first LED in a predetermined pixel with a corrected first LED gradation value lower than a first LED gradation value according to gradation data, and exerts lighting control on a second LED included in the predetermined pixel with a second LED gradation value according to gradation data. The predetermined main frame is at least one main frame included in the plurality of main frames. In the predetermined main frame, the first LED gradation value is lower than a first reference value, the second LED gradation value is lower than a second reference value, and a rate of a steady-state period to a whole lighting period in at least one lighting period is smaller than a predetermined value of less than 50% in at least one sub-frame in which lighting control is exerted over the first LED.

19 Claims, 9 Drawing Sheets

FIG.5

| First LED gradation value according to gradation data | Gradation value of sub-frames | | | |
|---|---|---|---|---|
| | Sub-frame 1 | Sub-frame 2 | Sub-frame 3 | Sub-frame 4 |
| 12 | 3 | 3 | 3 | 3 |
| 11 | 2 | 3 | 3 | 3 |
| 10 | 2 | 3 | 2 | 3 |
| 9 | 2 | 2 | 3 | 2 |
| 8 | 2 | 2 | 2 | 2 |
| 7 | 1 | 2 | 1 | 2 |
| 6 | 1 | 1 | 2 | 1 |
| 5 | 1 | 1 | 1 | 1 |
| 4 | 0 | 1 | 1 | 1 |
| 3 | 0 | 1 | 0 | 1 |
| 2 | 0 | 0 | 1 | 0 |
| 1 | 0 | 0 | 1 | 0 |
| 0 | 0 | 0 | 0 | 0 |

FIG.6

| Second LED gradation value according to gradation data | Gradation value of sub-frames | | | |
|---|---|---|---|---|
| | Sub-frame 1 | Sub-frame 2 | Sub-frame 3 | Sub-frame 4 |
| 12 | 3 | 3 | 3 | 3 |
| 11 | 2 | 3 | 3 | 3 |
| 10 | 2 | 3 | 2 | 3 |
| 9 | 2 | 2 | 3 | 2 |
| 8 | 2 | 2 | 2 | 2 |
| 7 | 1 | 2 | 2 | 2 |
| 6 | 1 | 2 | 1 | 2 |
| 5 | 1 | 1 | 2 | 1 |
| 4 | 1 | 1 | 1 | 1 |
| 3 | 0 | 1 | 1 | 1 |
| 2 | 0 | 1 | 0 | 1 |
| 1 | 0 | 0 | 1 | 0 |
| 0 | 0 | 0 | 0 | 0 |

FIG.8

| First LED gradation value according to gradation data | Gradation value of sub-frames | | | |
|---|---|---|---|---|
| | Sub-frame 1 | Sub-frame 2 | Sub-frame 3 | Sub-frame 4 |
| 12 | 3 | 3 | 3 | 3 |
| 11 | 2 | 3 | 3 | 3 |
| 10 | 2 | 3 | 2 | 3 |
| 9 | 2 | 2 | 3 | 2 |
| 8 | 2 | 2 | 2 | 2 |
| 7 | 1 | 2 | 2 | 2 |
| 6 | 1 | 2 | 1 | 2 |
| 5 | 1 | 1 | 2 | 1 |
| 4 | 1 | 1 | 1 | 1 |
| 3 | 0 | 1 | 1 | 1 |
| 2 | 0 | 1 | 0 | 1 |
| 1 | 0 | 0 | 1 | 0 |
| 0 | 0 | 0 | 0 | 0 |

FIG.9

| Second LED gradation value according to gradation data | Gradation value of sub-frames | | | |
|---|---|---|---|---|
| | Sub-frame 1 | Sub-frame 2 | Sub-frame 3 | Sub-frame 4 |
| 12 | 3 | 3 | 3 | 3 |
| 11 | 2 | 3 | 3 | 3 |
| 10 | 2 | 3 | 2 | 3 |
| 9 | 2 | 2 | 3 | 2 |
| 8 | 2 | 2 | 2 | 2 |
| 7 | 2 | 2 | 2 | 2 |
| 6 | 1 | 2 | 2 | 2 |
| 5 | 1 | 2 | 1 | 2 |
| 4 | 1 | 1 | 2 | 1 |
| 3 | 1 | 1 | 1 | 1 |
| 2 | 0 | 1 | 1 | 1 |
| 1 | 0 | 1 | 0 | 1 |
| 0 | 0 | 0 | 0 | 0 |

DISPLAY DEVICE

CROSS-REFERENCE TO RELATED APPLICATION

This application claims priority to Japanese Patent Application No. 2017-126797, filed on Jun. 28, 2017, the disclosure of which is hereby incorporated by reference in its entirety.

BACKGROUND

Field of the Invention

The present disclosure relates to a display device.

Discussion of the Background

There has been proposed a display device which includes a display unit including a plurality of LEDs, and a control unit performing lighting control over the plurality of LEDs (see Japanese Unexamined Patent Application Publication No. 2010-054989).

With the conventional display device, at a low gradation value (i.e., low luminance), the chromaticity and luminance of a predetermined LED becomes unstable, whereby the chromaticity of a predetermined pixel may fail to maintain or approximate a desired chromaticity.

SUMMARY

The above-described problem can be solved by the following means, for example.

A display device includes a display unit and a control unit. The display unit includes a plurality of pixels each including a first LED emitting light in a green color and a second LED emitting light in a color other than green. The control unit exerts lighting control on each of a plurality of main frames on the first LED and the second LED according to gradation data received from an external source.

In a predetermined main frame, the control unit exerts lighting control on the first LED in a predetermined pixel out of the plurality of pixels using a corrected first LED gradation value lower than a first LED gradation value according to the gradation data. The control unit exerts lighting control on the second LED in the predetermined pixel using a second LED gradation value according to the gradation data. The plurality of main frames each include a plurality of sub-frames. The predetermined main frame is at least one main frame in the plurality of main frames, in the predetermined main frame, the first LED gradation value is lower than a first reference value, the second LED gradation value is lower than a second reference value, and a rate in at least one lighting period of a steady-state period to a whole lighting period is smaller than a predetermined value of less than 50% in at least one sub-frame in which lighting control is exerted over the first LED.

The present disclosure can provide a display device in which the chromaticity obtained by actually observing/measuring a predetermined pixel maintains or approximates a desired chromaticity despite a very low gradation value (i.e., luminance) according to gradation data.

BRIEF DESCRIPTION OF THE DRAWINGS

FIG. 5 is a diagram explaining exemplary control exerted over first LEDs LED11 to LED14 in more detail.

FIG. 6 is a diagram explaining exemplary control exerted over second LEDs LED21 to LED24 in more detail.

FIG. 8 is a diagram explaining other exemplary control over the first LEDs LED11 to LED14 in more detail.

FIG. 9 is a diagram explaining other exemplary control over the second LEDs LED21 to LED24 in more detail.

DETAILED DESCRIPTION OF EMBODIMENT

Figure 1:
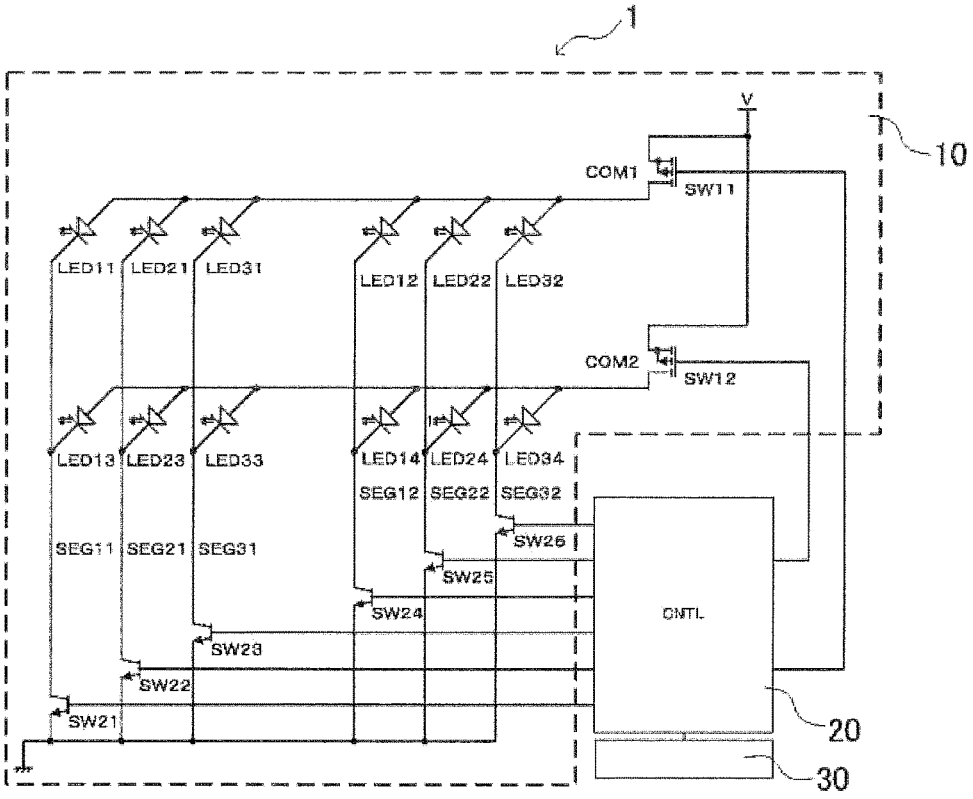
FIG. 1 is a circuit diagram of a display device 1 according to an embodiment.

FIG. 1 is a circuit diagram of a display device 1 according to an embodiment. As shown in FIG. 1, the display device 1 includes a display unit 10 and a control unit (CNTL) 20. The display unit 10 includes a plurality of pixels, and each of the pixels is structured by at least one of first LEDs LED11 to LED14 emitting green light, at least one of second LEDs LED21 to LED24 emitting red light, and at least one of third LEDs LED31 to LED34 emitting blue light.

In each pixel, the colors of light from the LEDs structuring the pixel are blended with each other. The gradation value (i.e., luminance) of each pixel is determined by the gradation value (i.e., luminance) of the LEDs structuring the pixel, and the gradation value (i.e., luminance) of each of the LEDs is determined by the lighting period of each of the LEDs.

Meanwhile, when a gradation value (i.e., luminance) according to gradation data is very low, the lighting period of the LEDs becomes very short, whereby the chromaticity and luminance of the LEDs become unstable.

Accordingly, even if the lighting control exerted for allowing the LEDs to light up at the gradation value (i.e., luminance) according to gradation data, a gradation value (i.e., luminance) obtained by actually observing/measuring the LEDs may fail to be equivalent to, or approximate, the gradation value (i.e., luminance) according to gradation data.

Accordingly, in the display device 1, when a gradation value (i.e., luminance) according to gradation data is very low, lighting control is exerted on a predetermined LED based on not the gradation value (i.e., luminance) according to gradation data, but on a gradation value (i.e., luminance) lower than the gradation value (i.e., luminance) according to gradation data.

Specifically, in the case where the first LEDs LED11 to LED14 emitting green light light up with a very low gradation value (i.e., luminance) according to gradation data, despite lighting control being exerted based on the gradation value (i.e., luminance), a gradation value (i.e., luminance) actually obtained by actual observation/measurement may become higher than the gradation value (i.e., luminance) according to gradation data.

Accordingly, when the first LEDs LED11 to LED14 emitting green light with a very low gradation value (i.e., luminance) according to gradation data, lighting control is exerted based on not the gradation value (i.e., luminance) according to gradation data, but on a gradation value (i.e., luminance) lower than the gradation value (i.e., luminance) according to gradation data.

Such lighting control still cannot improve the unstableness in chromaticity of the first LEDs LED11 to LED14 emitting green light. However, such control can mitigate that the gradation value (i.e., luminance) obtained by actual observation/measurement is deviated from the gradation value (i.e., luminance) according to gradation data. Accordingly, the unstableness in chromaticity and luminance of the first LEDs LED11 to LED14 emitting green light becomes less likely to incur unstableness in chromaticity and luminance of one whole pixel. Thus, the chromaticity of a predetermined pixel can maintain or approximate a desired chromaticity.

Plurality of LEDs LED11 to LED34

The display unit 10 includes a plurality of pixels. Each of the pixels is structured by, for example, at least one of the first LEDs LED11 to LED14, at least one of the second LEDs LED21 to LED24, and at least one of the third LEDs LED31 to LED34. Each of the LEDs is, for example, formed using a gallium nitride-based or gallium arsenide-based semiconductor. For example, the first LEDs LED11 to LED14 emitting green light and the third LEDs LED31 to LED34 emitting blue light can each be formed using a gallium nitride-based semiconductor, and the second LEDs LED21 to LED24 emitting red light can each be formed using a gallium arsenide-based or gallium phosphide-based semiconductor.

The first LEDs LED11 to LED14 are typically LEDs of which peak emission wavelength at a forward current of 20 mA is in a wavelength range of 500 nm to 560 nm.

The second LEDs LED21 to LED24 are typically LEDs of which peak emission wavelength at a forward current of 20 mA is in a wavelength range of 615 nm to 645 nm.

The third LEDs LED31 to LED34 are typically LEDs of which peak emission wavelength at a forward current of 20 mA is in a wavelength range of 450 nm to 490 nm.

Figure 2:
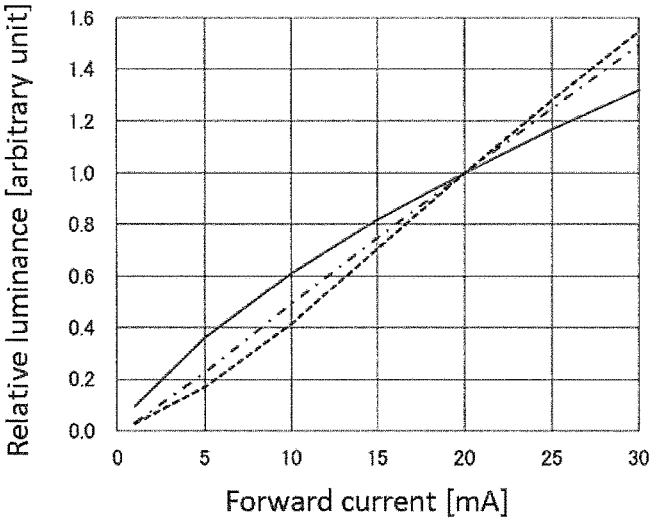
FIG. 2 is a graph showing the relationship between forward current and luminance as to LEDs emitting green light, LEDs emitting blue light, and LEDs emitting red light.

FIG. 2 is a graph showing the relationship between forward current and luminance for the LEDs emitting green light, the LEDs emitting blue light, and the LEDs emitting red light. FIG. 2 is a graph showing a luminance relative values taken as 1 when a forward current of 20 mA is applied. In FIG. 2, the solid line represents the relationship between forward current and luminance as to the LEDs emitting green light. The dot-and-dash line represents the relationship between forward current and luminance as to the LEDs emitting red light. The broken line represents the relationship between forward current and luminance as to the LEDs emitting blue light.

When lighting control is exerted with a very low gradation value (i.e., luminance), the current flowing through LEDs is very small. Here, as shown in FIG. 2, when the forward current is 20 mA or smaller, in other words, when the current flowing through the LEDs is very small, the luminance obtained by actually observing/measuring the LEDs emitting green light becomes higher than the assumed luminance (i.e., the luminance according to gradation data).

As a result, even if lighting control being exerted based on the same gradation value (i.e., luminance), the luminance obtained by actually observing/measuring the LEDs emitting green light becomes higher than the luminance obtained by actually observing/measuring LEDs emitting light in other colors. The reason is described in the following.

Figure 3A:
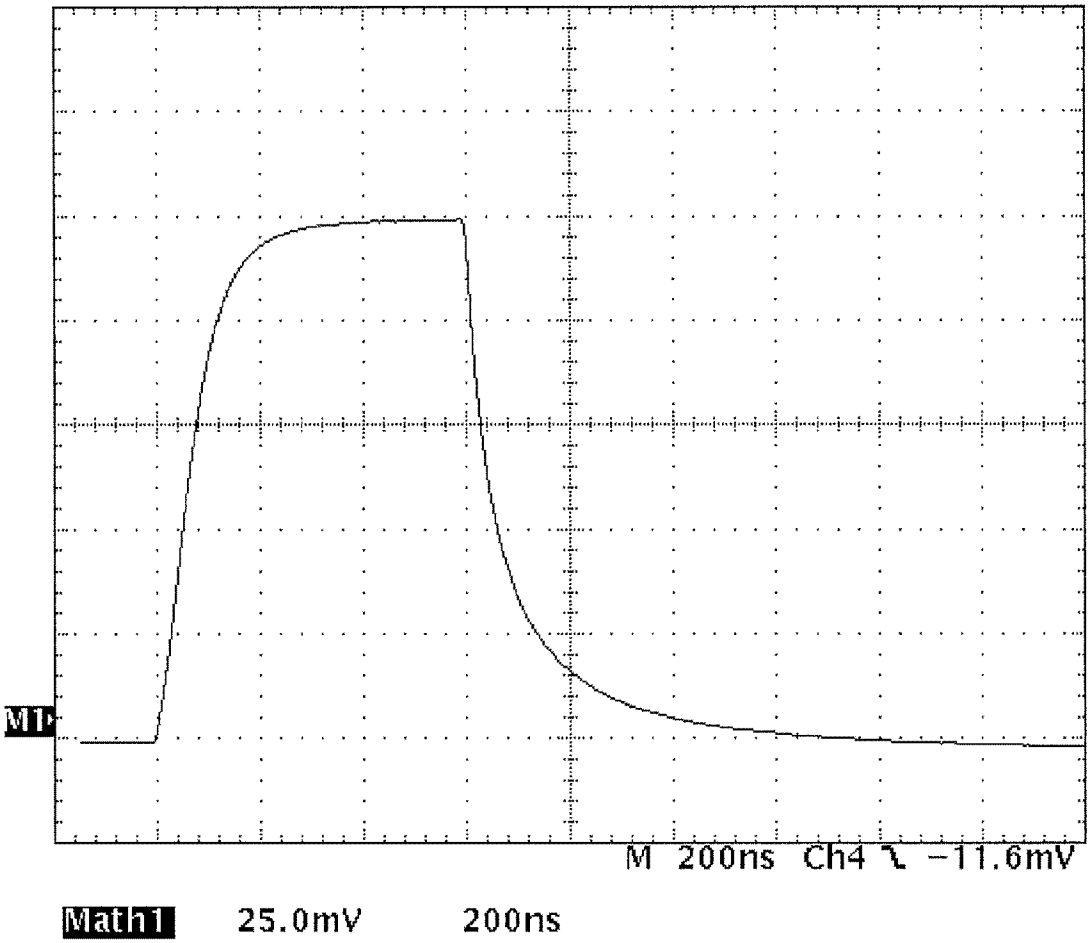
FIG. 3A is a graph showing one example of the relationship between time and output of first LEDs.
Figure 3B:
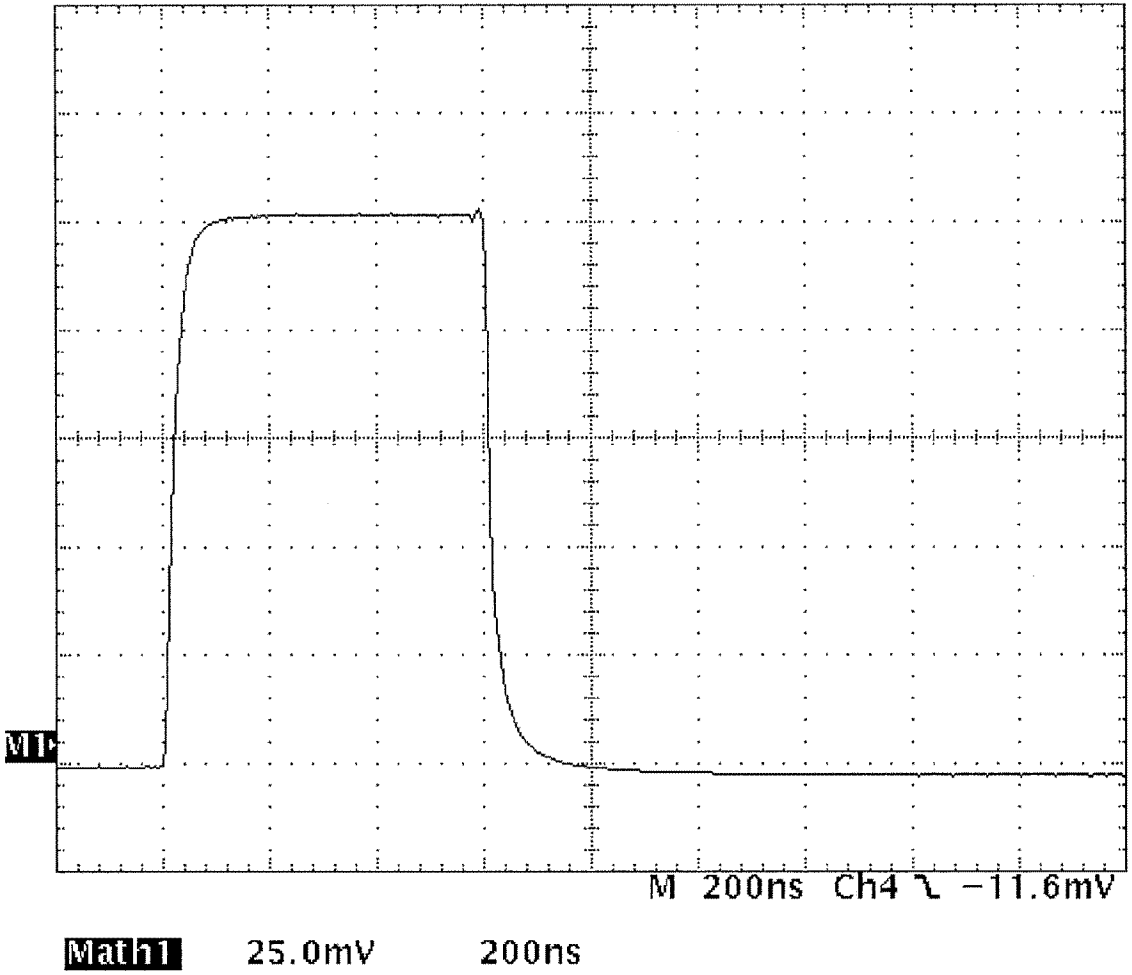
FIG. 3B is a graph showing the relationship between time and output of second LEDs.
Figure 3C:
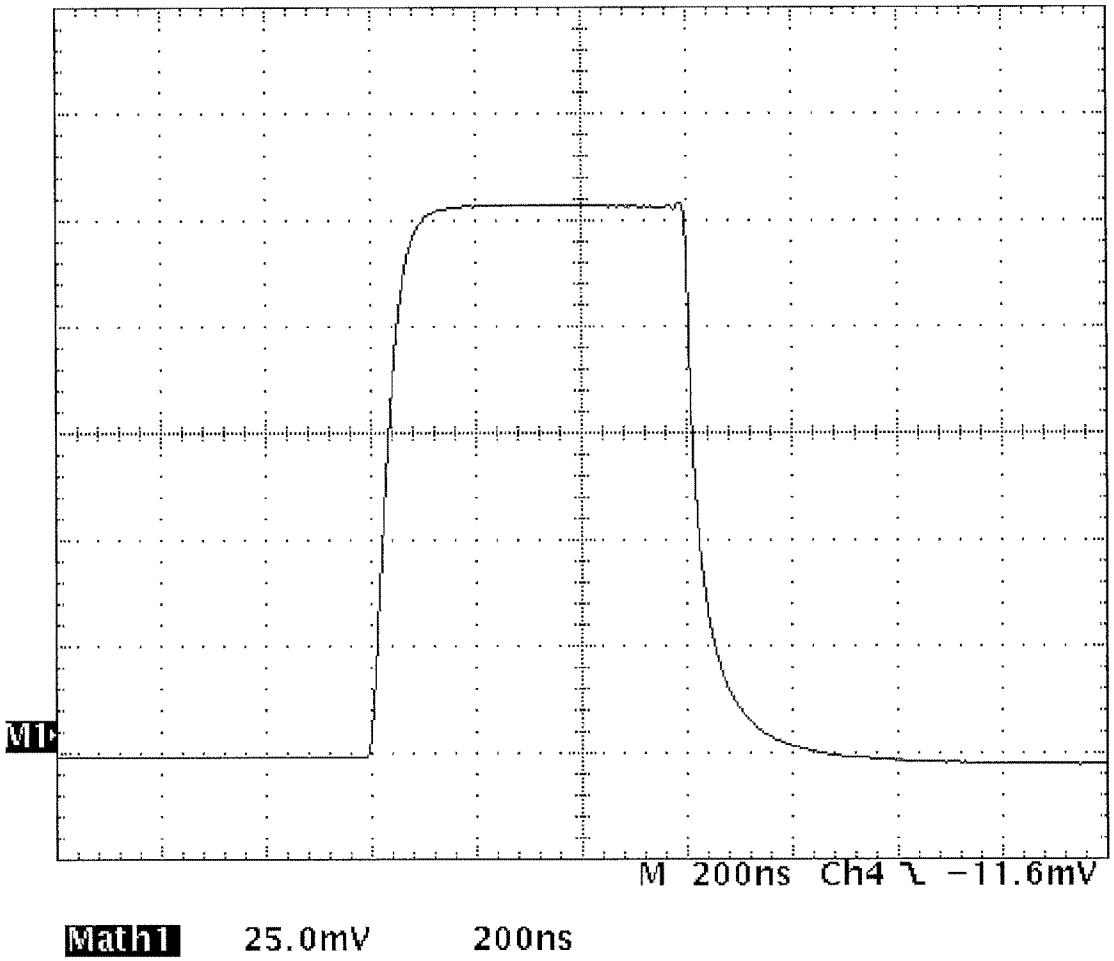
FIG. 3C is a graph showing the relationship between time and output of third LEDs.

FIG. 3A is a graph showing one example of the relationship between time and output of the first LEDs. FIG. 3B is a graph showing one example of the relationship between time and output of the second LEDs. FIG. 3C is a graph showing one example of the relationship between time and output of the third LEDs. In FIGS. 3A to 3C, the horizontal axis represents time, and the vertical axis represents values corresponding to output.

Further, in FIGS. 3A to 3C, the scale of the horizontal axis is in 200 ns increments, and the horizontal axis is in 10 increments.

As shown in FIGS. 3A to 3C, when a LED is pulse-driven, one lighting period, which is a period from the rising to the falling in the output of the LED, includes a steady-state period and a transient-state period.

The steady-state period refers to a period in which the output of the LED is stable, and the transient-state period refers to a period in which the output of the LED is unstable. The transient-state period is particularly observed at the rising and the falling of the output of the LED. The output of the LED is unstable in the transient-state period, and therefore the chromaticity and luminance of the LED becomes unstable.

As shown in FIG. 3A, the first LEDs LED11 to LED14 emitting green light have longer rise time and fall time of the output, and the transient-state period occupies a large share of one lighting period. The rise time refers to the time required for the output to transition from 10% to 90% of a rated value, and the fall time refers to the time required for the output to transition from 90% to 10% of a rated value.

(1) The first LEDs LED11 to LED14
Rise time of output=about 130 ns to 150 ns
Fall time of output=about 220 ns to 240 ns (2) The second LEDs LED21 to LED24
Rise time of output=about 40 ns to 45 ns
Fall time of output=about 50 ns to 55 ns (3) The third LEDs LED31 to LED34
Rise time of output=about 60 ns to 70 ns
Fall time of output=about 80 ns to 100 ns Accordingly, when one lighting period becomes very short and the transient-state period occupies a greater share of the one lighting period, the chromaticity and luminance of the first LEDs LED11 to LED14 emitting green light tend to be unstable than those of other LEDs emitting light in other colors.

Further, as compared to other LEDs emitting light in other colors, the first LEDs LED11 to LED14 emitting green light have greater variances in chromaticity and luminance attributed to variance in value of flowing current, and thus the chromaticity and luminance thereof in the transient-state period tend to largely deviate from the chromaticity and luminance in the steady-state period. As such, when one lighting period becomes very short, the value of flowing current tends to vary. Accordingly, due to this factor also, the chromaticity and luminance of the first LEDs LED11 to LED14 emitting green light tend to be unstable than those of other LEDs emitting light in other colors. While the specific reason why variances occur in chromaticity and luminance attributed to variances in value of flowing current is unclear, the difference in materials of LEDs is assumed to be at least one factor. That is, an LED with a greater amount of In contained in the active layer is assumed to have greater variances in chromaticity and luminance attributed to variances in current value than an LED with a smaller amount of In contained in the active layer.

Therefore, for example, when the active layer of each of the first LEDs LED11 to LED14 contains a greater amount of In than the active layer of each of the second LEDs LED21 to LED24 does, it is assumed that the first LEDs LED11 to LED14 tend to have greater variances in chromaticity and luminance attributed to variances in value of flowing current than the second LEDs LED21 to LED24 do.

As shown in FIGS. 3B and 3C, as compared to the first LEDs LED11 to LED14 emitting green light, the second LEDs LED21 to LED24 emitting red light and the third LEDs LED31 to LED34 emitting blue light have relatively short rise time and fall time of the output.

Therefore, when the lighting period of the second LEDs LED21 to LED24 and the third LEDs LED31 to LED34 becomes very short, the transient-state period is relatively short and a relatively long steady-state period is reliably obtained.

Further, the second LEDs LED21 to LED24 and the third LEDs LED31 to LED34 have relatively small variances in chromaticity and luminance attributed to variances in value of flowing current, and the chromaticity and luminance in the transient-state period do not largely differ from the chromaticity and luminance in the steady-state period.

Accordingly, the chromaticity and luminance of the second LEDs LED21 to LED24 emitting red light and the third LEDs LED31 to LED34 emitting blue light are relatively stable also in the case where one lighting period becomes very short.

Common Lines COM1, COM2

Common lines COM1, COM2 are connected to one end of each of the plurality of LEDs LED11 to LED34. The plurality of LEDs LED11 to LED34 can be connected to the common lines COM1, COM2 in the common anode structure, or can be connected to the common lines COM1, COM2 in the common cathode structure. The common lines COM1, COM2 can each be branched or diverged. While the number of the common lines is two in the present embodiment, the common lines are just required to be at least one in number.

Plurality of Drive Lines SEG11 to SEG32

A plurality of drive lines SEG11 to SEG32 is connected to the other end of each of the plurality of LEDs LED11 to LED34.

The common lines COM1, COM2 and the drive lines SEG11 to SEG32 can be formed using copper foil. The copper foil is, for example, part of the wiring of a printed wiring board. The common lines COM1, COM2 and the drive lines SEG11 to SEG32 can be formed into any of various shapes such as linear, planar (e.g., quadrangular, circular), on the printed wiring board or the like. The term "line" is not intended to specify the actual shape of the common lines COM1, COM2 and the drive lines SEG11 to SEG32 formed on a printed wiring board or the like to be linear, and is employed just because the common lines COM1, COM2 and the drive lines SEG11 to SEG32 can be schematically represented as lines in circuit diagrams.

Power Supply V

A power supply V supplies voltage to the plurality of LEDs LED11 to LED34. When the number of the common lines is two or more, the power supply V can be provided for each common line. Alternatively, the power supply V can be shared by two or more common lines.

When the power supply V is shared by two or more common lines, the voltage of the power supply V can be constantly applied to the common lines by the static control scheme, or can be time-divisionally applied by the dynamic control scheme. The power supply V can be, for example, a DC constant voltage source of the series scheme or the switching scheme.

Source Drivers SW11, SW12

Source drivers SW11, SW12 are switches for connecting between the common lines COM1, COM2 and the power supply V, and time-divisionally turned ON/OFF by the control unit 20. The source drivers SW11, SW12 can be P-channel type FETs or PNP transistors. FETs stand for Field Effect Transistors.

Sink Drivers SW21 to SW26

Sink drivers SW21 to SW26 are respectively connected to the plurality of drive lines SEG11 to SEG32. The sink drivers SW21 to SW26 are switches for connecting the plurality of drive lines SEG11 to SEG32 to GND, and turned ON/OFF by the control unit 20.

The sink drivers SW21 to SW26 can be NPN transistors or N-channel type FETs. Current flowing through the drive lines SEG11 to SEG32 can be controlled by any element or device such as a resistor, a constant current source, or the like. Such an elements or device can be disposed between the sink drivers SW21 to SW26 and GND, or between the sink drivers SW21 to SW26 and the plurality of LEDs LED11 to LED34.

Control Unit 20

The control unit 20 can be an FPGA, a microcomputer, or a combination of the foregoing. FPGA stands for Field Programmable Gate Array.

The control unit 20 exerts lighting control over the first LEDs LED11 to LED14, the second LEDs LED21 to LED24, and the third LEDs LED31 to LED34. The lighting control can be exerted by, for example, pulse width modulation (PWM).

That is, the control unit 20 turns ON/OFF the sink drivers SW21 to SW26 to apply voltage having a predetermined pulse width to the plurality of LEDs LED11 to LED34, thereby controlling the plurality of LEDs LED11 to LED34. In an exemplary case, the control unit 20 turns ON/OFF the sink driver SW12 and the sink driver SW25, thereby applying voltage of a predetermined pulse width to cause current to flow through the course of: the power supply V→the common line COM2→the second LED LED24→the drive line SEG22→GND. Thus, the second LED LED24 lights up for a predetermined time. The time during which the lighting continues is referred to as the lighting period in the present specification.

Figure 4:
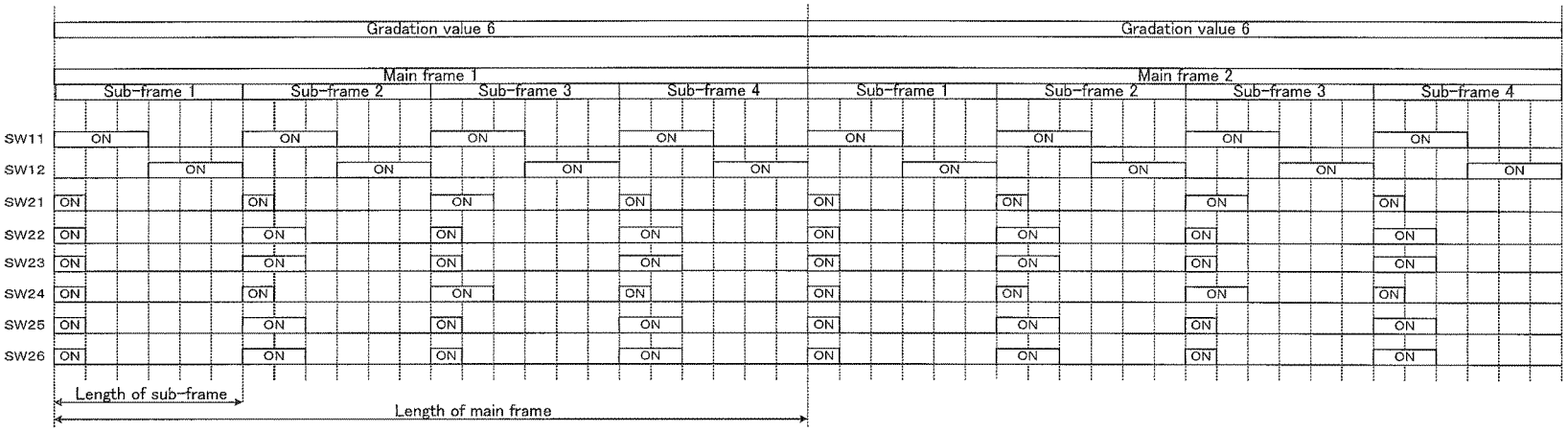
FIG. 4 is a timing chart explaining an exemplary operation of a control unit 20.

FIG. 4 is a timing chart explaining an exemplary operation of the control unit 20. As shown in FIG. 4, the control unit 20 exerts lighting control over the first LEDs LED11 to LED14, the second LEDs LED21 to LED24, and the third LEDs LED31 to LED34 in each of a plurality of main frames.

The plurality of main frames each include a plurality of sub-frames. The control unit 20 applies voltage of a predetermined pulse width to a lighting target LED in each individual sub-frame. The length of one main frame is preferably 16.7 ms (60 Hz) or 20 ms (50 Hz) if an image or the like is displayed using multiple main frames, and preferably from 8 ms to 15 ms, if a text message is displayed.

The gradation value (i.e., luminance) of an individual sub-frame corresponds to the pulse width of the voltage (i.e., the lighting period) in the individual sub-frame. As the gradation value (i.e., luminance) is higher, the pulse width (i.e., the lighting period) becomes longer, as the gradation value (i.e., luminance) is lower, the pulse width (i.e., the lighting period) becomes shorter. The quantitative relationship between the gradation value (i.e., luminance) and the pulse width (i.e., the lighting period) can be defined in various ways. In the present embodiment, "zero" gradation value corresponds to "zero" pulse width, i.e., when the gradation value is zero, the pulse width is zero.

Even in the case an LED does not light up, it might be occasionally described herein that "to exert lighting control over an LED with 0 gradation value" or "to pass current through an LED by applying voltage of 0 pulse width to the LED".

FIG. 5 is a diagram describing exemplary control exerted on the first LEDs LED11 to LED14 in more detail. In FIG. 5, the leftmost column shows gradation values of the first LEDs LED11 to LED14 in one main frame according to gradation data input from an external source, and the following right four columns show gradation values of the first LEDs LED11 to LED14 in respective sub-frames that constitute the main frame.

FIG. 6 is a diagram describing exemplary control exerted on the second LEDs LED21 to LED24 in more detail. Similarly to FIG. 5, in FIG. 6, the leftmost column shows gradation values of the second LEDs LED21 to LED24 in one main frame according to gradation data input from an external source, and the following right four columns show gradation values of the second LEDs LED21 to LED24 in respective sub-frames that constitute the main frame.

The lighting control over the first LEDs LED11 to LED14 in one main frame is realized by exerting lighting control so that the first LEDs LED11 to LED14 light up for lighting periods (i.e., pulse widths) respectively corresponding to the gradation values shown in the right four columns in FIG. 5 in each of a plurality of sub-frames.

Similarly, the lighting control on the second LEDs LED21 to LED24 in one main frame is realized by exerting lighting control so that the second LEDs LED21 to LED24 light up for lighting periods (i.e., pulse widths) respectively corresponding to the gradation values shown in the right four columns in FIG. 6 in each of a plurality of sub-frames.

The gradation value in one main frame can be obtained by adding the gradation values of the individual sub-frames. In this regard, the gradation values of the first LEDs LED11 to LED14 are explained as follow by using FIG. 5. In the case where a gradation value according to gradation data is very low, the value obtained by summing the gradation values of the individual sub-frames (i.e., the value obtained by summing the gradation values shown in the right four columns) becomes lower than the gradation value according to gradation data (i.e., the gradation value shown in the leftmost column). Otherwise, in the case where a gradation value according to gradation data is not very low, the value obtained by summing the gradation values of the individual sub-frames becomes equal to the gradation value according to gradation data (i.e., the gradation value shown in the leftmost column).

On the other hand, as to the second LEDs LED21 to LED24 as shown in FIG. 6, the value obtained by summing the gradation values of the individual sub-frames (i.e., the value obtained by summing the gradation values shown in the right four columns) always becomes equal to the gradation value according to gradation data (i.e., the gradation value shown in the leftmost column).

In the present specification, "the gradation value according to gradation data" of the n-th LED is referred to as the n-th gradation value, and "the gradation value lower than the gradation value according to gradation data" of the n-th LED is referred to as the corrected n-th gradation value. Here, n is an integer satisfying the condition of $1 \leq n \leq 3$.

As shown in FIGS. 5 and 6, the control unit 20 corrects the first LED gradation value in a predetermined main frame, and exerts lighting control on the first LEDs LED11 to LED14 with the corrected first LED gradation value lower than the first LED gradation value.

That is, the corrected gradation value of the first LEDs LED11 to LED14 in a predetermined main frame (i.e., the value obtained by summing the gradation values of the individual sub-frames) is lower than the first LED gradation value corresponding to the gradation data. On the other hand, the control unit 20 exerts lighting control on the second LEDs LED21 to LED24 with the original second LED gradation value.

A predetermined main frame is a main frame in which a gradation value according to gradation data is low and the lighting period corresponding to the gradation value is short, whereby the chromaticity and luminance actually observed (i.e., measured) for the first LEDs LED11 to LED14 hardly coincide with the desired chromaticity and luminance (i.e., the chromaticity and luminance according to gradation data).

Specifically, a predetermined main frame is at least one main frame included in the plurality of main frames, in which the first LED gradation value is lower than a first reference value and the second LED gradation value is lower than a second reference value, and in which the rate of the steady-state period to the whole one lighting period in at least one lighting period is smaller than a predetermined value of at least 0% and less than 50%, in at least one sub-frame where lighting control is exerted on the first LEDs.

Here, the first reference value and the second reference value can be an identical value or different values. In the present embodiment, the first reference value and the second reference value are an identical value, which is gradation value 8.

The corrected first LED gradation value is smaller than the first LED gradation value. The corrected first LED gradation value is preferably smaller than the first LED gradation value by at least 2 and less than 36, and more preferably by at least 10 and less than 20.

In the present embodiment, it is assumed that the following relationship is established when the first gradation value is 2 or greater: the corrected first LED gradation value+1=the first LED gradation value. However, when the first LED gradation value is 0 or 1, the first LED gradation value is not corrected and the lighting control is exerted on the first LEDs with the original first LED gradation value. This is because the gradation value cannot be further reduced, describing in detail, because there exist no negative gradation values and setting gradation value 1 to gradation value 0 means that LEDs never light up).

In the present embodiment, it is assumed that the measured luminance value (i.e., the luminance obtained by actual observation or measurement) of the first LEDs lighting up with the corrected first LED gradation value is 50 cd/m$^2$ or smaller.

The control unit 20 can exert lighting control on the first LEDs with the original first LED gradation value, and exert lighting control on the second LEDs with the original second LED gradation value in a main frame other than the predetermined main frame.

In the main frame other than the predetermined main frame, the gradation value according to gradation data is relatively high, and the chromaticity and luminance of the first LEDs LED11 to LED14 are relatively stable. Accordingly, it is not necessary to correct the first LED gradation value, and it is not necessary to cause the first LEDs to operate with the corrected first LED gradation value. Specifically, for example, the main frame satisfying at least one of the following conditions (1) to (3) falls into the main frame other than the predetermined main frame:

(1) The first LED gradation value is equal to or greater than the first reference value;

(2) The second LED gradation value is equal to or greater than the second reference value; and (3) In at least one sub-frame in which the lighting control is exerted on the first LEDs, the rate of the steady-state period to the whole lighting period in at least one lighting period is a predetermined value of at least 0% and less than 50%.

Example of main frame that satisfies at least one of the foregoing conditions (1) to (3) includes one in which the LEDs are caused to light up at a luminance of 5000 cd/m$^2$ and a chromaticity of X value=0.290 and Y value=0.300.

Control exerted on the third LEDs LED31 to LED34 is similar to control on the second LEDs LED21 to LED24 and, therefore, an illustration and a detailed description thereof are omitted. In brief, the control unit 20 can exert lighting control over the third LEDs with the original third LED gradation value according to gradation data in the predetermined main frame.

Further, the control unit 20 can exert lighting control over the third LEDs with the original third LED gradation value according to gradation data also in the main frame other than the predetermined main frame. The predetermined main frame in this case is the one that satisfies a condition that the third LED gradation value is lower than the third reference value, or at least one of the conditions described above. The third reference value can be a value identical to or different from the first reference value or the second reference value.

As described above, with the display device 1, when a gradation value (i.e., luminance) according to gradation data is very low, lighting control is exerted on the first LEDs LED11 to LED14 emitting green light, of which output tends to become unstable under lighting control with a low gradation value, with a gradation value (i.e., luminance) lower than the gradation value (i.e., luminance) according to gradation data.

That is, lighting control is exerted on the first LEDs LED11 to LED14 emitting green light with a lighting period shorter than a lighting period corresponding to the gradation value (i.e., luminance) according to gradation data. Still, such lighting control cannot improve unstableness in chromaticity of the first LEDs LED11 to LED14 emitting green light. However, such lighting control minimizes deviation of a gradation value (i.e., luminance) obtained by actual observation/measurement from the gradation value (i.e., luminance) according to the gradation data. Consequently, this minimizes unstableness in chromaticity and luminance of the whole pixel attributed to unstableness in chromaticity and luminance of the first LEDs LED11 to LED14 emitting green light. Hence, the chromaticity obtained by actually observing/measuring a predetermined pixel can be maintained or approximated a desired chromaticity.

In addition to the original first LED gradation value determined by gradation data, the first LED gradation value according to gradation data includes a previously corrected gradation value which is obtained by correcting the first LED gradation value specified by gradation data in view of a current value or an optimized lighting period.

In the latter case, the first LED gradation value specified by gradation data is previously corrected for at least once, and further corrected according to the present embodiment, to provide the corrected first LED gradation value. The same holds true for the second LED gradation value or the third LED gradation value, which will be described later.

The control unit 20 exerts lighting control according to the present embodiment on a predetermined pixel. That is, the lighting control according to the present embodiment can be exerted on the first LEDs LED11 to LED14, the second LEDs LED21 to LED24, and the third LEDs LED31 to LED34 included in every pixel, or just on the first LEDs LED11 to LED14, the second LEDs LED21 to LED24, and the third LEDs LED31 to LED34 included in part of the plurality of pixels.

In view of reducing deviation in chromaticity of the pixels, preferably the lighting control according to the present embodiment is exerted over the first LEDs LED11 to LED14, the second LEDs LED21 to LED24, and the third LEDs LED31 to LED34 included in every pixel.

Other Exemplary Operation of Control Unit 20

Figure 7:
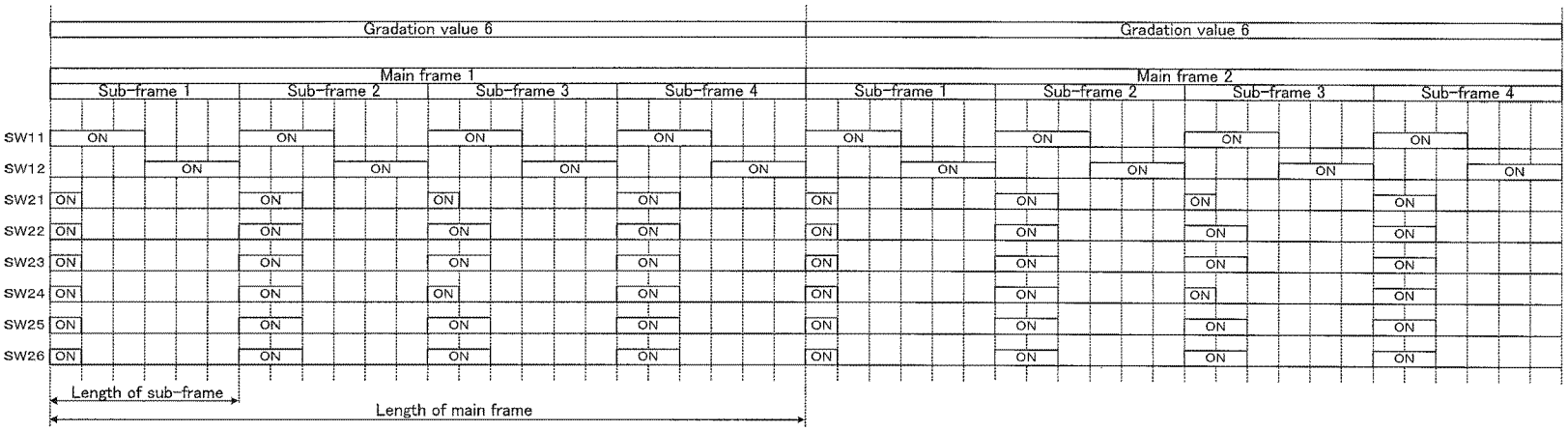
FIG. 7 is a timing chart explaining other exemplary operation of the control unit 20.
Figure 10:
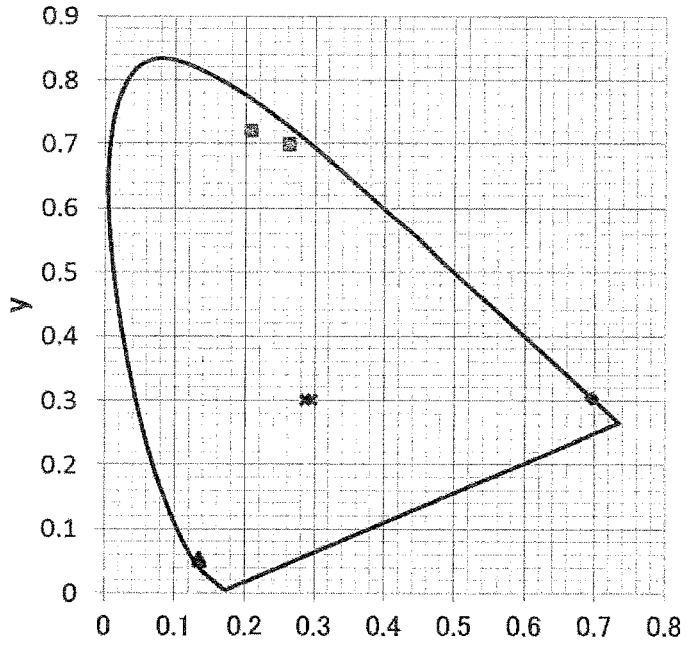
FIG. 10 is a chromaticity diagram based on Table 1.
Figure 11:
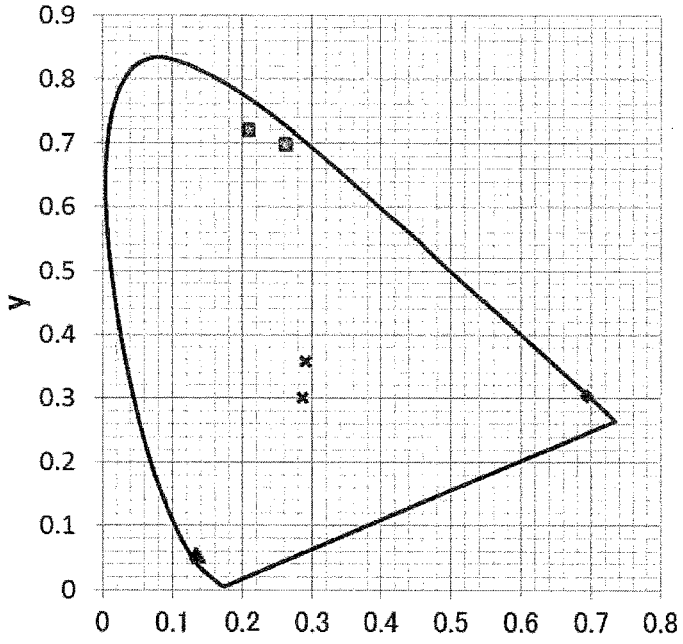
FIG. 11 is a chromaticity diagram based on Table 2.

FIG. 7 is a timing chart explaining other exemplary operation of the control unit 20. FIG. 8 is a diagram explaining other exemplary control over the first LEDs LED11 to LED14 in more detail. FIG. 9 is a diagram explaining other exemplary control over the second LEDs LED21 to LED24 in more detail. As shown in FIGS. 7 to 9, while the control unit 20 can exert lighting control on the first LEDs with the original first LED gradation value according to gradation data in the predetermined main frame, the control unit 20 can exert lighting control on the second LEDs with a corrected second LED gradation value which is higher than the second LED gradation value according to gradation data.

That is, while the control unit 20 can exert lighting control on the first LEDs with a lighting period corresponding to the first LED gradation value according to the gradation data, the control unit 20 can exert lighting control on the second LEDs with a lighting period longer than a lighting period corresponding to the second LED gradation value according to gradation data.

Further, the control unit 20 can exert lighting control on the third LEDs with a corrected third LED gradation value which is higher than the third LED gradation value according to gradation data in the predetermined main frame. That is, the control unit 20 can exert lighting control on the third LEDs with a lighting period longer than a lighting period corresponding to the third LED gradation value according to gradation data. In this manner, by correcting the second LED gradation value or the third LED gradation value while maintaining the original first LED gradation value, the effect similar to that exhibited by the above-described exemplary operation is exhibited.

The corrected second LED gradation value is greater than the second LED gradation value, preferably greater than the second LED gradation value by at least 2 and less than 18, more preferably by at least 5 and less than 10. In the present embodiment, it is assumed that the following relationship is established: the corrected second LED gradation value−1=the second LED gradation value. Similarly, the corrected third LED gradation value is greater than the third LED gradation value, preferably greater than the third LED gradation value by at least 2 and less than 18, more preferably by at least 5 and less than 10.

In the present embodiment, it is assumed that the following relationship is established: the corrected third LED gradation value−1=the third LED gradation value.

In the present embodiment, it is assumed that the measured luminance value (i.e., the luminance obtained by actual observation or measurement) of the second LEDs lighting up with the corrected second LED gradation value is 20 cd/m$^2$ or smaller, and the measured luminance value (i.e., the luminance obtained by actual observation or measurement) of the third LEDs lighting up with the corrected third LED gradation value is 10 cd/m$^2$ or smaller.

The foregoing is the description of other exemplary operation of the control unit 20. Except for the foregoing points, other exemplary operation is similar to the above-described exemplary operation and, therefore, the description thereof is omitted.

Display Device According to Example

Next, a description will be given of a display device according to Example.

A display device according to Example includes: 1728 pieces of LEDs arranged in a matrix at an interval of 4 mm; 24 pieces of common lines disposed in the lateral direction; 216 pieces (72 pieces×3 colors) of drive lines disposed in the longitudinal direction; a constant voltage source of DC 5V as a power supply; an FPGA as a control unit; P-channel type FETs as source drivers; and constant-current-driven NPN transistors as sink drivers.

The display device includes 576 pieces of pixels. Each of the pixels is structured by one first LED emitting green light, one second LED emitting red light, and one third LED emitting blue light. In other words, 1728 pieces of LEDs consist of 576 pieces of the first LEDs emitting green light, 576 pieces of the second LEDs emitting red light, and 576 pieces of the third LEDs emitting blue light. The sink drivers are set to pass a current of 18.7 mA through the first LEDs, a current of 16.8 mA through the second LEDs, and a current of 16.8 mA through the third LEDs. The common lines are connected to the anode side of the LEDs, and the drive lines are connected to the cathode side of the LEDs.

To the common lines, voltage is time-divisionally applied by the dynamic lighting system. The duty ratio is 1/24, a period in which voltage is applied to one common line is 47.9 us, and a period in which voltage is applied to none of the common lines is 10 us. Here, based on (47.9 μs+10 μs)×24 Duty=1.389 ms, the length of one sub-frame is 1.389 ms.

One main frame consists of 32 pieces of sub-frames. Based on 1.389 ms×32=44.4 ms, the length of one main frame is 44.4 ms.

The gradation value of each sub-frame can be controlled by 64 levels (0 to 63) by the pulse width modulation. The gradation value of the whole main frame (i.e., the first LED gradation value) can be controlled by the number of sub-frames 32×64 levels=2048 levels (0 to 2047). The pulse width and the gradation value are in the relationship of: pulse width=gradation value×72.9 ns.

As to the first LEDs, by applying voltage having a pulse width of 1166.7 ns or greater, that is, by applying voltage during the lighting period in which gradation value is equal to or greater than 16 (i.e., 1166.7 ns/72.9 ns≈16), the chromaticity and luminance approximating the desired chromaticity and luminance (i.e., the chromaticity and luminance when the pulse width is great enough) can be obtained at observation/measurement.

On the other hand, as to the second LEDs and the third LEDs, by applying voltage having a pulse width of 72.9 ns or greater, that is, voltage equal to or greater than gradation value of 1 (i.e., 72.9 ns/72.9 ns=1), the chromaticity and luminance approximating the desired chromaticity and luminance can be obtained at observation/measurement.

The above-described display device is discussed as to the case where the first LED gradation value according to gradation data (i.e., the gradation value of the whole main frame) is 32 and the case where it is 1024.

When the first LED gradation value according to gradation data (i.e., the gradation value of the whole main frame) is 32, equally allocating the gradation value of the whole main frame to the sub-frames, the gradation value of each sub-frame is 1 (i.e., the gradation value of the whole main frame of 32/the number of the subframes of 32=1), and the pulse width in each sub-frame is 72.9 ns (i.e., 72.9 ns×gradation value 1=72.9 ns).

Accordingly, the chromaticity and luminance of the first LEDs emitting green light become unstable in every sub-frame, and the chromaticity and luminance actually observed/measured deviate from the desired chromaticity and luminance.

Therefore, when the first LED gradation value according to gradation data (i.e., the gradation value of the whole main frame) is 32, the control unit reduces the first LED gradation value from 32 to 20, and exerts lighting control over the first LEDs with the corrected first LED gradation value of 20. Specifically, the control unit changes the gradation value in a predetermined sub-frame from 1 to 0, and sets the gradation value of the whole main frame to 20.

On the other hand, when the first LED gradation value according to gradation data (i.e., the gradation value of the whole main frame) is 1024, equally allocating the gradation value of the whole main frame to the sub-frames, the gradation value of each sub-frame is 32 (i.e., the gradation value of the whole main frame 1024/the number of sub-frames 32=32). Accordingly, the pulse width in each sub-frame is 2333.3 ns (i.e., 72.9 ns×the gradation value 32=2333.3 ns). Thus, the first LEDs emitting green light lighting up at the desired chromaticity and luminance are observed/measured.

In both of the cases where the first LED gradation value according to gradation data (i.e., the gradation value of the whole main frame) is 32 and where it is 1024, the control unit exerts lighting control with gradation value 1 in every sub-frame for the second LEDs and the third LEDs.

The Table 1 below shows the chromaticity and luminance obtained by actual observation/measurement under such lighting control, and FIG. 8 is a chromaticity diagram based on Table 1.

TABLE 1

| Gradation | White | | | Red | | | Green | | | Blue | | |
|---|---|---|---|---|---|---|---|---|---|---|---|---|
| value | x | y | Lv | x | y | Lv | x | y | Lv | x | y | Lv |
| 32 | 0.298 | 0.300 | 5.8 | 0.696 | 0.304 | 1.3 | 0.262 | 0.699 | 3.7 | 0.137 | 0.055 | 0.5 |
| 1024 | 0.289 | 0.300 | 204.8 | 0.696 | 0.303 | 48.6 | 0.208 | 0.721 | 140.7 | 0.139 | 0.050 | 16.4 |

In Table 1, "Red" shows the chromaticity and luminance obtained by actual observation/measurement of the second LEDs, "Green" shows the chromaticity and luminance obtained by actual observation/measurement of the first LEDs, and "Blue" shows chromaticity and luminance obtained by actual observation/measurement of the third LEDs.

Further, "White" shows the chromaticity and luminance obtained by actual observation/measurement of all the LEDs as a whole. That is, "White" shows the chromaticity and luminance which is a combination of the chromaticity and luminance obtained by actual observation/measurement of the first LEDs, the chromaticity and luminance obtained by actual observation/measurement of the second LEDs, and the chromaticity and luminance obtained by actual observation/measurement of the third LEDs.

As shown in Table 1, with the display device according to Example, the chromaticity of "White" is x value=0.298 and y value=0.300 when the first LED gradation value is 32 (i.e., when lighting control is exerted with the corrected first LED gradation value of 20), and it is x value=0.289 and y value=0.300 when the first LED gradation value is 1024 (i.e., when lighting control is exerted with the original first LED gradation value of 1024).

Accordingly, between the case where the first LED gradation value is 32 and the case where it is 1024, a deviation of 0.009 (0.009=0.298−0.289) occurs as to x value, and no deviation occurs as to y value (0=0.300−0.300).

When the first LED gradation value is 32, the luminance is 5.8 cd/m$^2$ on "White", 1.3 cd/m$^2$ on "Red", 3.7 cd/m$^2$ on "Green", 0.5 cd/m$^2$ on "Blue". Further, when the first LED gradation value is 1024, the luminance is 204.8 cd/m$^2$ on "White", 48.6 cd/m$^2$ on "Red", 141.7 cd/m$^2$ on "Green", and 16.4 cd/m$^2$ on "Blue".

Next, a description will be given of a display device according to Comparative Example.

The display device according to Comparative Example is different from the display device according to Example in lighting control of the first LEDs. The rest of the structure is similar to the display device according to Example.

Specifically, in Comparative Example, when the first LED gradation value according to gradation data (i.e., the gradation value of the whole main frame) is 32 also, the gradation value of the whole main frame is equally allocated to the sub-frames, and the first LEDs are lit with gradation value 1 (i.e., the gradation value with which the chromaticity and luminance are unstable) in every sub-frame.

The Table 2 below shows the chromaticity and luminance obtained by actual observation/measurement under such lighting control, and FIG. 9 is a chromaticity diagram based on Table 2.

TABLE 2

| Gradation | White | | | Red | | | Green | | | Blue | | |
|---|---|---|---|---|---|---|---|---|---|---|---|---|
| value | x | y | Lv | x | y | Lv | x | y | Lv | x | y | Lv |
| 32 | 0.294 | 0.357 | 8.0 | 0.696 | 0.303 | 1.3 | 0.263 | 0.699 | 5.9 | 0.137 | 0.055 | 0.5 |
| 1024 | 0.289 | 0.300 | 204.9 | 0.696 | 0.303 | 48.5 | 0.208 | 0.721 | 140.9 | 0.139 | 0.050 | 16.4 |

As shown in Table 2, with the display device according to Comparative Example, the chromaticity of "White" is x value=0.294 and y value=0.357 when the first LED gradation value is 32 (i.e., when lighting control is exerted with the original first LED gradation value 32), and the chromaticity of "White" is x value=0.289 and y value=0.300 when the first LED gradation value is 1024 (i.e., when lighting control is exerted with the original first LED gradation value 1024).

Accordingly, between the case where the first LED gradation value is 32 and the case where it is 1024, a deviation of 0.005 (0.005=0.294−0.289) occurs on x value, and a deviation of 0.057 (0.057=0.357−0.300) occurs on y value.

When the first LED gradation value is 32, luminance is 8.0 cd/m$^2$ on "White", 1.3 cd/m$^2$ on "Red", 5.9 cd/m$^2$ on "Green", and 0.5 cd/m$^2$ on "Blue". When the first LED gradation value is 1024, luminance is 204.9 cd/m$^2$ on "White", 48.5 cd/m$^2$ on "Red", 140.9 cd/m$^2$ on "Green", and 16.4 cd/m$^2$ on "Blue".

As described above, with the display device according to Comparative Example, between the case where the first LED gradation value is 32 and the case where it is 1024, a deviation of 0.005 occurs on x value and a deviation of 0.057 occurs on y value in the chromaticity of "White".

In contrast, with the display device according to Example, while a deviation of 0.009 occurs on x value, a deviation of 0 occurs on y value.

That is, a deviation occurs in the chromaticity of the first LEDs by substantially the same magnitude in both Example and Comparative Example. However, with the display device according to Example, the luminance of the first LEDs obtained by actual observation/measurement becomes lower than the value according to gradation data. Therefore, the influence of the deviation in luminance of the first LEDs reduces, and the deviation in chromaticity of "White" realized by combining colors of the first LEDs, the second LEDs, and the third LEDs reduces.

On the other hand, with the display device according to Comparative Example, the luminance of the first LEDs obtained by actual observation/measurement becomes greater than the luminance according to gradation data.

Therefore, the deviation in luminance of the first LEDs becomes influential and the chromaticity of "White" greatly deviates.

In the foregoing, while the description has been given of the embodiment and Example, the description relates to an example, and does not limit the structure described in the scope of claims.

Industrial Applicability

The display device of the present disclosure is useful as, for example, a large-screen TV, a traffic information board, or the like.

What is claimed is:

1. A display device comprising:

a display unit including a plurality of pixels, the plurality of pixels each including a first LED emitting light in a green color and a second LED emitting light in a color other than green; and a control unit exerting lighting control on each of a plurality of main frames on the first LED and the second LED according to gradation data received from an external source, wherein in a predetermined main frame, the control unit exerts lighting control on the first LED in a predetermined pixel out of the plurality of pixels using a corrected first LED gradation value lower than a first LED gradation value according to the gradation data, and exerts lighting control on the second LED in the predetermined pixel using a second LED gradation value according to the gradation data, the plurality of main frames each include a plurality of sub-frames, the predetermined main frame is at least one main frame in the plurality of main frames, and in the predetermined main frame, the first LED gradation value is lower than a first reference value, the second LED gradation value is lower than a second reference value, and a rate in at least one lighting period of a steady-state period to a whole lighting period is smaller than a predetermined value of less than 50% in at least one sub-frame in which lighting control is exerted over the first LED.

2. The display device according to claim 1, wherein, the plurality of main frames includes a main frame including at least one sub-frame in which lighting control is exerted on the first LED, the at least one sub-frame has a rate of the steady-state period to the whole lighting period in at least one lighting period becomes equal to or greater than the predetermined value, and the control unit exerts lighting control on the first LED in the predetermined pixel with the first LED gradation value.

3. The display device according to claim 1, wherein the plurality of pixels each further includes a third LED emitting light in a color different from the color of the light emitted by the first LED and the color of the light emitted by the second LED, the control unit further exerts lighting control on the third LED included in the predetermined pixel using a third LED gradation value according to the gradation data of the predetermined main frame, and the predetermined main frame is a main frame in which the third LED gradation value is lower than a third reference value.

4. The display device according to claim 2, wherein the plurality of pixels each further includes a third LED emitting light in a color different from the color of the light emitted by the first LED and the color of the light emitted by the second LED, the control unit further exerts lighting control on the third LED included in the predetermined pixel using a third LED gradation value according to the gradation data of the predetermined main frame, and the predetermined main frame is a main frame in which the third LED gradation value is lower than a third reference value.

5. A display device comprising:

a display unit including a plurality of pixels, the plurality of pixels each including a first LED emitting light in a green color and a second LED emitting light in a color other than green; and a control unit exerting lighting control in each of a plurality of main frames on the first LED and the second LED according to gradation data received from an external source, wherein in a predetermined main frame, the control unit exerts lighting control on the first LED in a predetermined pixel out of the plurality of pixels using a first LED gradation value according to the gradation data, and exerts lighting control on the second LED in the predetermined pixel using a corrected second LED gradation value higher than a second LED gradation value according to the gradation data, the plurality of main frames each include a plurality of sub-frames, the predetermined main frame is at least one main frame included in the plurality of main frames, and in the predetermined main frame, the first LED gradation value is lower than a first reference value, the second LED gradation value is lower than a second reference value, and a rate in at least one lighting period of a steady-state period to a whole lighting period is smaller than a predetermined value of less than 50%, in at least one sub-frame in which lighting control is exerted over the first LED.

6. The display device according to claim 5, wherein, the plurality of main frames includes a main frame including at least one sub-frame in which lighting control is exerted on the first LED in the predetermined pixel, the at least one sub-frame has a rate of the steady-state period to the whole lighting period in at least one lighting period becomes equal to or greater than the predetermined value, and the control unit exerts lighting control on the second LED in the predetermined pixel with the second LED gradation value.

7. The display device according to claim 5, wherein the plurality of pixels each further includes a third LED emitting light in a color different from the color of the light emitted by the first LED and the color of the light emitted by the second LED, the control unit further exerts lighting control on the third LED included in the predetermined pixel using a corrected third LED gradation value higher than a third LED gradation value according to the gradation data of the predetermined main frame, and the predetermined main frame is a main frame in which the third LED gradation value is lower than a third reference value.

8. The display device according to claim 6, wherein the plurality of pixels each further includes a third LED emitting light in a color different from the color of the light emitted by the first LED and the color of the light emitted by the second LED, the control unit further exerts lighting control on the third LED included in the predetermined pixel using a corrected third LED gradation value higher than a third LED gradation value according to the gradation data of the predetermined main frame, and the predetermined main frame is a main frame in which the third LED gradation value is lower than a third reference value.

9. The display device according to claim 3, wherein the second LED is an LED emitting light in a red color, and the third LED is an LED emitting light in a blue color.

10. The display device according to claim 7, wherein the second LED is an LED emitting light in a red color, and the third LED is an LED emitting light in a blue color.

11. The display device according to claim 3, wherein a measured value of luminance of the third LED undergoing lighting control using a corrected third LED gradation value is equal to or smaller than 10 cd/m$^2$.

12. The display device according to claim 7, wherein a measured value of luminance of the third LED undergoing lighting control using a corrected third LED gradation value is equal to or smaller than 10 cd/m$^2$.

13. The display device according to claim 9, wherein a measured value of luminance of the third LED undergoing lighting control using a corrected third LED gradation value is equal to or smaller than 10 cd/m$^2$.

14. The display device according to claim 1, wherein a measured value of luminance of the first LED undergoing lighting control using the corrected first LED gradation value is equal to or smaller than 50 cd/m$^2$.

15. The display device according to claim 5, wherein a measured value of luminance of the first LED undergoing lighting control using the corrected first LED gradation value is equal to or smaller than 50 cd/m$^2$.

16. The display device according to claim 1, wherein a measured value of luminance of the second LED undergoing lighting control using a corrected second LED gradation value is equal to or smaller than 20 cd/m$^2$.

17. The display device according to claim 5, wherein a measured value of luminance of the second LED undergoing lighting control using a corrected second LED gradation value is equal to or smaller than 20 cd/m$^2$.

18. The display device according to claim 14, wherein a measured value of luminance of the second LED undergoing lighting control using a corrected second LED gradation value is equal to or smaller than 20 cd/m$^2$.

19. The display device according to claim 15, wherein a measured value of luminance of the second LED undergoing lighting control using a corrected second LED gradation value is equal to or smaller than 20 cd/m$^2$.

* * * * *